US009802132B2

(12) United States Patent
Chen

(10) Patent No.: US 9,802,132 B2
(45) Date of Patent: Oct. 31, 2017

(54) SPINNER SWING

(71) Applicant: Samuel Chen, Shanghai (CN)

(72) Inventor: Samuel Chen, Shanghai (CN)

( * ) Notice: Subject to any disclaimer, the term of this patent is extended or adjusted under 35 U.S.C. 154(b) by 0 days.

(21) Appl. No.: 15/376,079

(22) Filed: Dec. 12, 2016

(65) Prior Publication Data

US 2017/0189819 A1 Jul. 6, 2017

Related U.S. Application Data

(60) Provisional application No. 62/273,697, filed on Dec. 31, 2015.

(51) Int. Cl.
*A63G 9/00* (2006.01)
*A47C 3/00* (2006.01)

(52) U.S. Cl.
CPC ..... *A63G 9/00* (2013.01)

(58) Field of Classification Search
CPC ... A63G 9/00; A63G 9/10; A63G 9/12; A47C 3/00; A47C 3/0255; A47C 11/005; A47D 9/02; A47D 13/105; A47D 13/107
USPC ..... 472/118–125; 297/273–274, 77
See application file for complete search history.

(56) References Cited

U.S. PATENT DOCUMENTS

| | | | | | |
|---|---|---|---|---|---|
| 213,518 | A * | 3/1879 | McGregor | A47D 13/10 | 297/184.1 |
| 1,196,375 | A * | 8/1916 | Medart | A63G 9/16 | 472/122 |
| 3,937,463 | A * | 2/1976 | Soisson | A63G 9/00 | 24/129 D |
| 4,256,300 | A * | 3/1981 | Boucher | A63G 9/00 | 182/155 |
| 4,365,819 | A * | 12/1982 | Bart | A63H 3/52 | 280/47.41 |
| 8,454,450 | B1 * | 6/2013 | Cordray | A63G 9/00 | 472/118 |

* cited by examiner

*Primary Examiner* — Kien Nguyen
(74) *Attorney, Agent, or Firm* — Clement Cheng

(57) ABSTRACT

A spinner swing includes a suspension frame, including a pair of front supports and a pair of rear supports. The pair of front supports and the pair of rear supports holds a horizontal beam. The pair of front supports includes a first front support and a second front support. The pair of rear supports includes a first rear support and a second rear support. A suspension line system is connected to the horizontal beam. A swing frame is suspended from the suspension line system. The suspension line system allows rotation of the swing frame. The swing frame has an outer seat frame that is a rounded circular or oval shape. A fabric panel is mounted across the outer seat frame. A first seat is mounted in the swing frame.

15 Claims, 2 Drawing Sheets

SPINNER SWING

This non-provisional application claims priority from U.S. provisional application Ser. No. 62/273,697 entitled Spinner Swing filed Dec. 31, 2015 by the same inventor Samuel Chen, the disclosure of which is incorporated herein by reference.

FIELD OF THE INVENTION

The present invention is in the field of spinner swings.

DISCUSSION OF RELATED ART

Swings can be made of discarded tires that can be tied from tree branches. Discarded tires can be tied in a horizontal fashion to allow horizontal swinging. Unfortunately, tires have the disadvantage of chalking and the materials that tires are made of are not always very suitable for contact with children. A variety of spinning saucer swings have been developed based upon horizontally mounted tire swings where the spinning saucer swings are plastic injection molded and hold children in a concave area that can provide seating.

SUMMARY OF THE INVENTION

A spinner swing includes a suspension frame, including a pair of front supports and a pair of rear supports. The pair of front supports and the pair of rear supports holds a horizontal beam. The pair of front supports includes a first front support and a second front support. The pair of rear supports includes a first rear support and a second rear support. A suspension line system is connected to the horizontal beam. A swing frame is suspended from the suspension line system. The suspension line system allows rotation of the swing frame. The swing frame has an outer seat frame that is a rounded circular or oval shape. A fabric panel is mounted across the outer seat frame. A first seat is mounted in the swing frame. A first seat opening is formed in front of the first seat. A second seat is mounted in the swing frame and a second seat opening is formed in front of the second seat.

The spinner swing also optionally includes, a first seat frame rail and a second seat frame rail extending from a rear end of the outer seat frame to a front end of the outer seat frame. The first seat frame rail and the second seat frame rail are parallel to each other. The first seat and the second seat are mounted to and between the first seat frame rail and the second seat frame rail. The first seat seatback is formed on the first seat, and a second seat seatback is formed on the second seat.

A fabric panel bridge can be formed between the first seat opening and the second seat opening. The suspension line system may further include a first suspension connector connected to the horizontal beam, and a second suspension connector connected to the horizontal beam. The first suspension connector suspends a first suspension line, and the second suspension connector suspends a second suspension line. The first suspension line and the second suspension line connect to the outer seat frame.

The first suspension line has a first suspension line junction at which the first suspension line branches to connect to a first suspension line front connection and a first suspension line rear connection on the outer seat frame. The second suspension line has a second suspension line junction at which the second suspension line branches to connect to a second suspension line front connection and a second suspension line rear connection on the outer seat frame. A fabric panel sleeve is preferably formed on the fabric panel, wherein the fabric panel sleeve is mounted to the outer seat frame.

Figure 1:
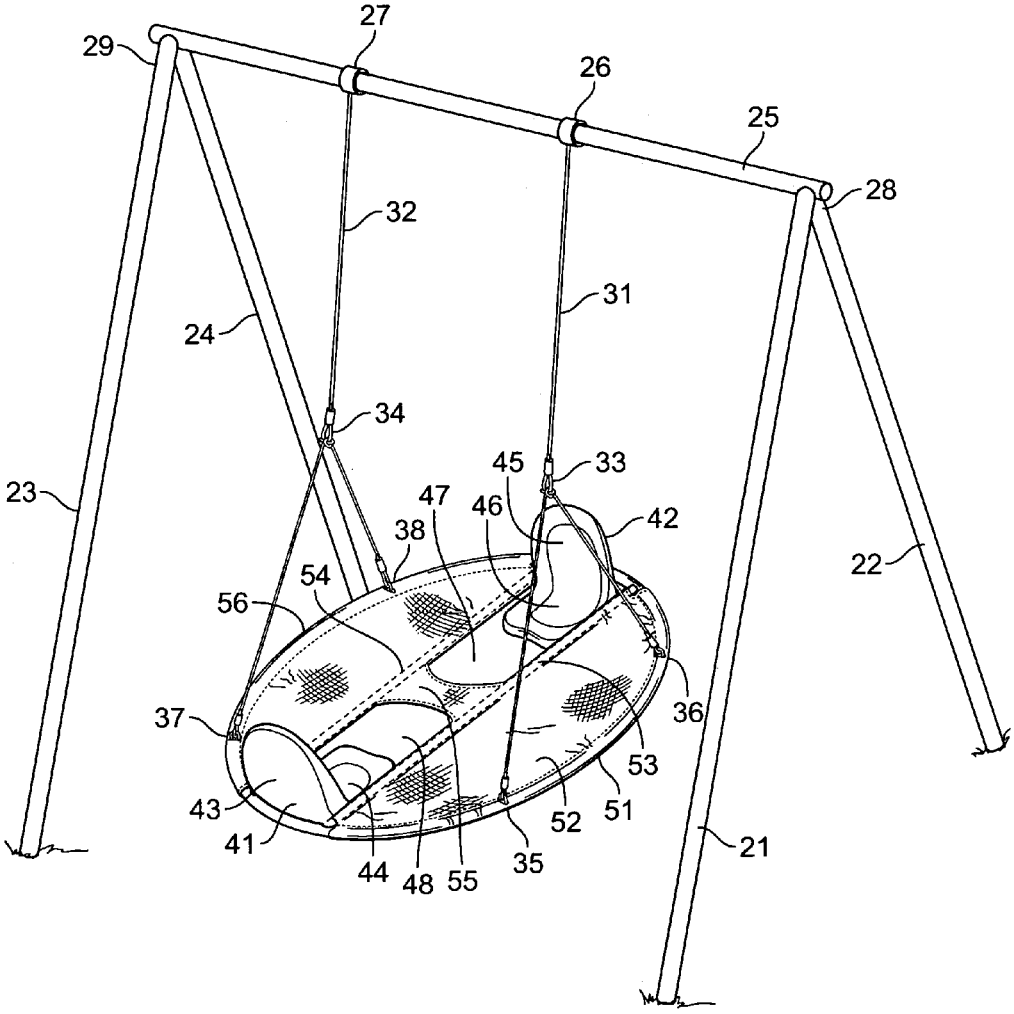
FIG. 1 is a perspective view of the present invention.
Figure 2:
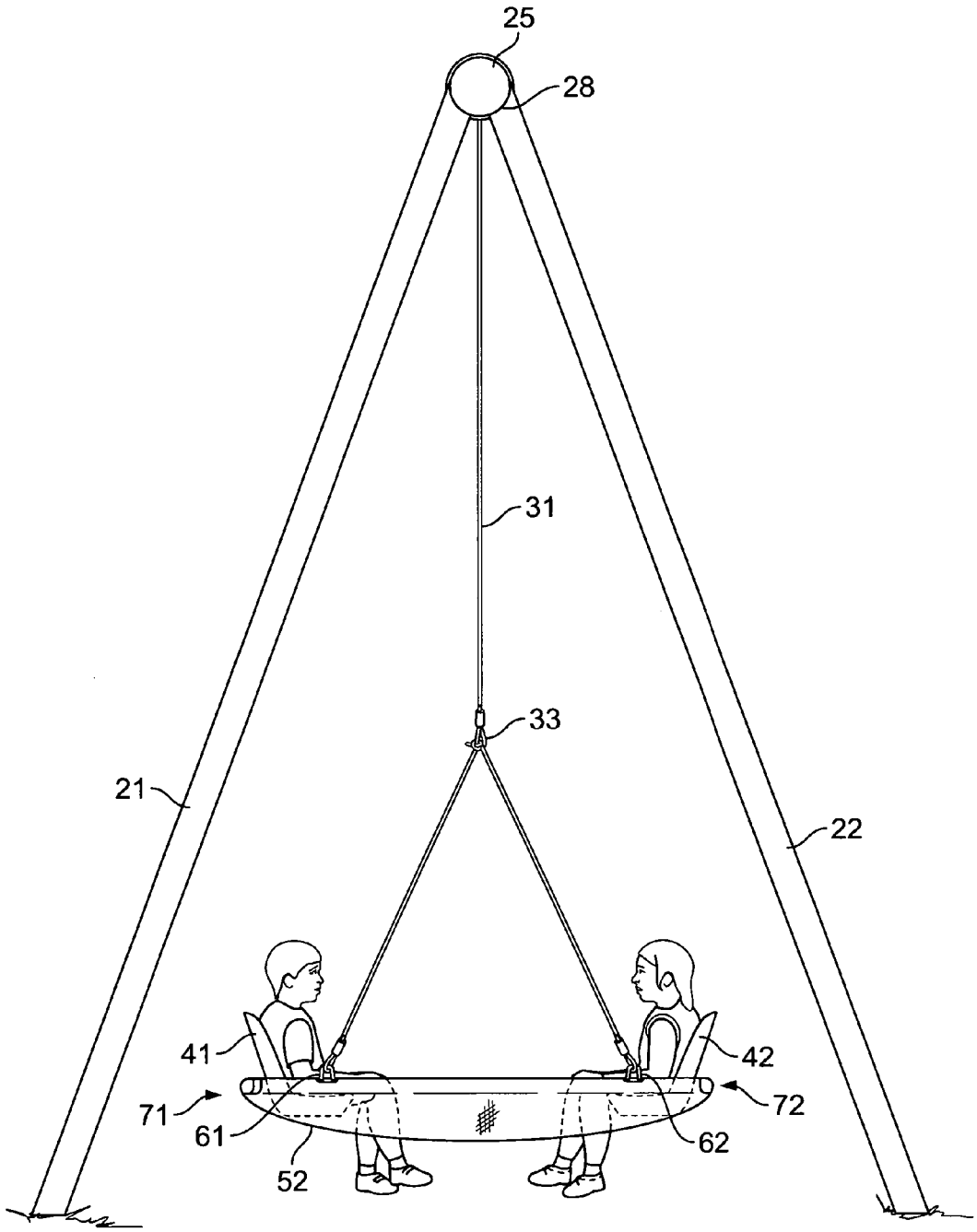
FIG. 2 is a side view of the present invention.

The following call out list of elements can be a useful guide in referencing the element numbers of the drawings.

21 First Front Support
22 First Rear Support
23 Second Front Support
24 Second Rear Support
25 Horizontal Beam
26 First Suspension Connector
27 Second Suspension Connector
28 First Frame Joint
29 Second Frame Joint
31 First Suspension Line
32 Second Suspension Line
33 First Suspension Line Junction
34 Second Suspension Line Junction
35 First Suspension Line Front Connection
36 First Suspension Line Rear Connection
37 Second Suspension Line Front Connection
38 Second Suspension Line Rear Connection
41 Front Seat
42 Rear Seat
43 Front Seat Seatback
44 Front Seat Seat Base
45 Rear Seat Seatback
46 Rear Seat Seat Base
47 Rear Seat Opening
48 Front Seat Opening
51 Outer Seat Frame
52 Seat Frame Fabric Sheathing Panel
53 First Seat Frame Rail
54 Second Seat Frame Rail
55 Fabric Panel Bridge
56 Fabric Panel Sleeve
61 Eyelet Loop
71 Front End Of Outer Seat Frame
72 Rear End Of Outer Seat Frame

DETAILED DESCRIPTION OF THE PREFERRED EMBODIMENT

The present invention has a swing suspended from a frame. The swing is constructed with a swing frame, at least a pair of seats and a flexible preferably fabric covering. The frame includes a pair of first legs and a pair of second legs. For example, the first front support 21 can be angled from a first rear support 22. Similarly, the second front support 23 can be angled from a second rear support 24. The lower ends of the legs formed as tubes can be left open so that the tubes dig into the ground and secure the frame of the spinner swing. Alternatively, the lower ends of the legs can be capped with end caps such as footings with grip. The frame disassembles to a disassembled state.

The first and second pair of legs are spaced apart from each other and parallel to each other to provide a swinging space between the four legs. The first frame joint 28 can rigidly connect the upper end of the first rear support 22 to the upper end of the first front support 21. The first frame joint 28 can be formed as a socketed connector that has welded sockets. Alternatively, the upper end of the first rear support 22 and the upper end of the first front support 21 can be welded to the first frame joint 28 directly with a saddle weld. Similarly, the second frame joint 29 can rigidly connect the second front support 23 to the second rear support 24 at upper ends of the second pair of legs. The second pair of legs can be angled to have the same angle as the first pair of legs when forming a general A-frame type of construction. Therefore, the frame can be welded, or socketed together with metal bolts, or both welded and socketed together with metal bolts.

A horizontal beam 25 connects the first frame joint 28 to the second frame joint 29. The horizontal beam 25 can be a tubular steel member similar to the first and second pair of legs. The tubular steel members can be galvanized or powder coated for improved environmental resistance and may have welded ends or plastic end caps. A first suspension connector 26 can connect to the horizontal beam 25. A second suspension connector 27 can also connect to the horizontal beam 25. The first and second suspension connectors are optionally slidably mounted so that a user can slide the suspension connectors toward and away from each other to provide a spinning configuration or a stable configuration. When a user desires to have a spinning configuration, the user can slide the second suspension connector 27 toward the first suspension connector 26. The pair of suspension connectors, namely the first suspension connector 26 and the second suspension connector 27 can be formed as collars such as steel rings that slide along and are user adjustable along the horizontal beam 25. Optionally, set screws can selectively secure the suspension connectors to the horizontal beam 25.

When the user wants a more stable configuration, the user can have the suspension connectors spaced apart from each other. For a stable but also spinning configuration, the user can orient the first and second suspension connectors so that the first suspension line 31 is parallel to the second suspension line 32. The first suspension line 31 can cross over the second suspension line 32 to provide a spinning configuration when the users optionally so desire. The first suspension connector 26 and the second suspension connector 27 can also be secured such as by a set screw to prevent modifications by young children. The horizontal beam 25 thus acts as a rail for receiving the pair of suspension connectors.

Preferably, the first suspension line junction 31 includes a first suspension line junction 33 where it branches and connects to a first suspension line rear connection 36 and a first suspension line front connection 35. The branching can be formed by a steel cable loop where the branched lines are connected to the steel cable loop. The suspension line junctions can be formed as steel cable loops. The steel cable loops can be formed by clamping each suspension line with cable clamps such as crimped cable clamps.

Similarly, the second suspension line 32 includes a second suspension line junction 34 where it branches and connects to a second suspension line rear connection 38 and a second suspension line front connection 37. The pair of suspension lines each branch and connect to the outer seat frame 51. The connection locations on the outer seat frame 51 can be equaled distantly spaced with each suspension connection being approximately 90° from the others. The outer seat frame 51 can be made of tubular steel that is connected in sections by bolts and generally circular or oval in configuration. Optionally, a hardware connector such as a steel link loop can be used for the branch connection.

The outer seat frame 51 is preferably made of a tubular steel member that has a pair of seats mounted on it. The front seat 41 faces backward to face the rear seat 42. The front seat 41 has a front seat seatback 43 connected to a front seat seat base 44. The front seat seatback 43 extends upwardly from the front seat seat base 44. Optionally, a cushion can be mounted across the seating surface of the front seat 41 to allow grip to retain the user to the front seat 41. Similarly, the rear seat 42 has a rear seat seatback 45 and a rear seat seat base 46. The front seat and the rear seat are provided with a front seat opening 48 and a rear seat opening 47 to allow users to extend their feet downward to either kick or walk along the ground so as to propel the spinner swing. The users can use their feet to first start swinging, and then start rotating. The present invention also allows a tilting motion where the rear seat can be tilted above the front seat such as seen in the first figure, or where the rear seat can be tilted below the front seat in a wobbling fashion. Therefore, the present invention allows a swinging motion, a rotating motion and potentially a wobbling motion as well. A variety of combinations and permutations of these types of motions and multiple degrees of freedom of movement can provide spinning enjoyment for youngsters until they are motion sick with joy.

As users are steadily incapacitated by excessive spinning, the seats have safety panels to the left and right of the seats. The safety panels have a concave depression for catching dizzy users. The outer seat frame 51 is covered by a seat frame fabric sheathing panel 52. A right panel and a left panel, or a first panel and a second panel connected across the outer seat frame 51. The frame fabric sheathing panel 52 can be formed as a right panel and a left panel with a fabric panel bridge 55 connecting the pair of panels. A fabric panel sleeve 56 can retain the fabric panel to the outer seat frame 51. The seats can be mounted to a first seat frame rail 53 and a second seat frame rail 54. The first seat frame rail 53 is parallel to the second seat frame rail 54 and can be encapsulated within a portion of the fabric panel sleeve 56. The seat frame rails including the first seat frame rail and the second seat frame rail are connected to the outer seat frame 51 to provide rigidity and structure to the seat frame. The panels are preferably of a heavy fabric sufficient to hold a user in case of excessive dizziness or dynamic instability.

The fabric panel bridge 55 provides a transfer of forces between the first panel and the second panel. The fabric panel bridge can be reinforced by folding fabric toward the fabric panel bridge and overlapping the fabric at the fabric panel bridge area. The seats can be connected to the outer seat frame 51 by bolts or other connectors. The seats can also be connected to the outer seat frame 51 using a strap such as a fabric strap.

The fabric panels can have openings that fit over eyelet loops 61. The eyelet loops 61 allow connection of the suspension lines to the outer seat frame 51, and can be welded or bolted to the outer seat frame 51. Four eyelet loops 61 can be configured to form the first suspension line front connection 35, the first suspension line rear connection 36, the second suspension line front connection 37 and the second suspension line rear connection 38. The suspension line connections can be made using a crimped cable clamp such as an aluminum soft metal cable clamp deformed by a crimp tool for making a solid connection. Optionally, the eyelet loops 61 can be covered with a polyolefin foam sheathing for user protection.

A first seat frame rail and second seat frame rail extend from a rear end of the outer seat frame to a front end of the outer seat frame. The front end of the outer seat frame 71 opposes the rear end of outer seat frame 72. The front end of the outer seat frame 71 and the rear end of outer seat frame 72 are optionally both uncovered by the fabric panel sleeves.

The following claims define the scope of the invention.

The invention claimed is:

1. A spinner swing comprising:

a. a suspension frame, including a pair of front supports and a pair of rear supports, wherein the pair of front supports and the pair of rear supports holds a horizontal beam, wherein the pair of front supports includes a first front support and a second front support, and wherein the pair of rear supports includes a first rear support and a second rear support;

b. a suspension line system connected to the horizontal beam;

c. a swing frame suspended from the suspension line system, wherein the suspension line system allows rotation of the swing frame, wherein the swing frame has an outer seat frame that is a rounded circular or oval shape;

d. a fabric panel mounted across the outer seat frame;

e. a first seat mounted in the swing frame;

f. a first seat opening formed in front of the first seat;

g. a second seat mounted in the swing frame; and h. a second seat opening formed in front of the second seat, wherein a fabric panel bridge is horizontally oriented and divides the first seat opening from the second seat opening, wherein the fabric panel bridge is mounted in between the first seat opening and the second seat opening.

2. The spinner swing of claim 1, further including: a first seat frame rail and a second seat frame rail extending from a rear end of the outer seat frame to a front end of the outer seat frame, wherein the first seat frame rail and the second seat frame rail are parallel to each other, wherein the first seat and the second seat are mounted to and between the first seat frame rail and the second seat frame rail.

3. The spinner swing of claim 1, further including: a first seat seatback formed on the first seat, and a second seat seatback formed on the second seat.

4. The spinner swing of claim 1, further including: a fabric panel bridge formed between the first seat opening and the second seat opening.

5. The spinner swing of claim 1, wherein the suspension line system further includes a first suspension connector connected to the horizontal beam, and a second suspension connector connected to the horizontal beam, wherein the first suspension connector suspends a first suspension line, and wherein the second suspension connector suspends a second suspension line, wherein both the first suspension line and the second suspension line connect to the outer seat.

6. The spinner swing of claim 5, wherein the first suspension line has a first suspension line junction at which the first suspension line branches to connect to a first suspension line front connection and a first suspension line rear connection on the outer seat frame, and wherein the second suspension line has a second suspension line junction at which the second suspension line branches to connect to a second suspension line front connection and a second suspension line rear connection on the outer seat frame.

7. The spinner swing of claim 5, farther including: a first seat frame rail and a second seat frame rail extending from a rear end of the outer seat frame to a front end of the outer seat frame, wherein the first seat frame rail and the second seat frame rail are parallel to each other, wherein the first seat and the second seat are mounted to and between the first seat frame rail and the second seat frame rail.

8. The spinner swing of claim 5, further including: a first seat seatback formed on the first seat, and a second seat seatback formed on the second seat.

9. The spinner swing of claim 5, further including: a fabric panel bridge formed between the first seat opening and the second seat opening.

10. The spinner swing of claim 5, further including: a fabric panel sleeve formed on the fabric panel, wherein the fabric panel sleeve is mounted to the outer seat frame.

11. The spinner swing of claim 10, wherein the first suspension line has a first suspension line junction at which the first suspension line branches to connect to a first suspension line front connection and a first suspension line rear connection on the outer seat frame, and wherein the second suspension line has a second suspension line junction at which the second suspension line branches to connect to a second suspension line front connection and a second suspension line rear connection on the outer seat frame.

12. The spinner swing of claim 10, further including: a first seat frame rail and a second seat frame rail extending from a rear end of the outer seat frame to a front end of the outer seat frame, wherein the first seat frame rail and the second seat frame rail are parallel to each other, wherein the first seat and the second seat are mounted to and between the first seat frame rail and the second seat frame rail.

13. The spinner swing of claim 10, further including: a first seat seatback formed on the first seat, and a second seat seatback formed on the second seat.

14. The spinner swing at claim 10, further including: a fabric panel bridge formed between the tint seat opening and the second seat opening.

15. The spinner swing of claim 10, further including: wherein the first suspension line has a first suspension line junction at which the first suspension line branches to connect to a first suspension line front connection and a first suspension line rear connection on the outer seat frame, and wherein the second suspension line has a second suspension line junction at which the second suspension line branches to connect to a second suspension line front connection and a second suspension line rear connection on the outer seat frame; further including: a first seat frame rail and a second seat frame rail extending from a rear end of the outer seat frame to a front end of the outer seat frame, wherein the first seat frame rail and the second seat frame rail are parallel to each other, wherein the first seat and the second seat are mounted to and between the first seat frame rail and the second seat frame rail; further including: a first seat seatback formed on the first seat, and a second seat seatback formed on the second seat; further including: a fabric panel bridge formed between the first seat opening and the second seat opening.

* * * * *